US005608918A

United States Patent [19]

Salvaggio

[11] Patent Number: 5,608,918

[45] Date of Patent: Mar. 11, 1997

[54] HELMET STRAP STABILIZER CLIP

[75] Inventor: Frank Salvaggio, Mount Royal, Canada

[73] Assignee: Western State Import Company, Inc., Camarillo, Calif.

[21] Appl. No.: 303,030

[22] Filed: Sep. 8, 1994

[51] Int. Cl.[6] ..... A42B 3/08; A44B 11/00

[52] U.S. Cl. ..... 2/421; 2/422; 24/169; 24/198; 24/519

[58] Field of Search ..... 2/410, 411, 421, 2/422, 425; 24/324, 169, 197, 198, 518, 519

[56] References Cited

U.S. PATENT DOCUMENTS

| | | | |
|---|---|---|---|
| 2,586,758 | 2/1952 | Zerr | 24/518 |
| 2,846,683 | 8/1958 | Dye et al. | 2/421 |
| 4,038,726 | 8/1977 | Takabayashi | 24/169 |
| 4,897,888 | 2/1990 | Broersma | 2/421 |
| 5,005,220 | 4/1991 | Gaiatto et al. | 2/421 |
| 5,007,141 | 4/1991 | Gentes | 2/421 |
| 5,023,958 | 6/1991 | Rotzin | 2/421 |
| 5,083,321 | 1/1992 | Davidsson | 2/421 |
| 5,123,121 | 6/1992 | Broersma | 2/421 |
| 5,176,106 | 1/1993 | Casto et al. . | |
| 5,245,730 | 9/1993 | Martin . | |
| 5,263,214 | 11/1993 | McLaughlin et al. . | |
| 5,272,773 | 12/1993 | Kamata | 2/421 |

*Primary Examiner*—Michael A. Neas

*Attorney, Agent, or Firm*—Heller Ehrman White & McAuliffe

[57] ABSTRACT

A movable rear strap stabilizer clip for use with a helmet's strapping system. The stabilizer clip provides a bridge between the rear straps at a location distal from the back portion of the helmet. The stabilizer clip provides an additional support point in the helmet's strapping system for greater conformability with the user's head.

8 Claims, 3 Drawing Sheets

HELMET STRAP STABILIZER CLIP

BACKGROUND OF THE INVENTION

The present invention relates generally to helmet retention, and more particularly to a rear strap stabilizer clip for improving the strapping system of helmets used for bicycling, in-line roller skating, skate boarding, etc.

In the past several years, bicycle riders have increasingly chosen to wear helmets while riding. They have done so for several reasons. The foremost reason is an appreciation for the protection that is offered by a helmet in preventing or reducing head injuries during an accident. Many states have also enacted laws that require young riders, and even adults, to wear helmets. In addition, new bicycle helmet designs are attractive and incorporate new technologies, and this has also led to the growing acceptance and use of bicycle helmets.

In addition, with the advent of sports such as in-line roller skating, street hockey, skate boarding, etc., helmets now have even wider use. In fact, protection for the head in these sports may be deemed essential, given their speeds and the environments facing participants. Helmets are also viewed by many participants in these sports as a fashion accessory.

A typical helmet is made of a hard plastic shell and, underneath the shell, a softer shock absorbing material is used. Unlike motorcycle helmets, most helmets used in the aforementioned sports only cover the top of the head. Often, only a few standard sizes are available. These helmets require a strapping system to secure the helmet to the wearer's head. The helmet typically has straps attached to the sides and back portions of the helmet, which are, in turn, connected to a chin strap. The length of these straps are adjustable so as to provide a fit for a variety of wearers.

The strapping systems of helmets currently being used, however, still do not provide the wearer with an entirely comfortable fit. It is desirable to have an improved strapping system for helmets that provides greater conformability and comfort for wearers.

SUMMARY OF THE INVENTION

An object of the present invention, therefore, is to provide a helmet with an improved strapping system that is simple to use.

Another object of the present invention is to provide a rear strap stabilizer clip to improve conformability of the strapping system of a helmet.

The present invention is directed to a helmet having a strapping system that has a moveable rear strap stabilizer clip, which provides a bridge between the rear straps of the helmet at a location distal from the back portion of the helmet. The rear strap stabilizer clip comprises a junction base plate member having gripping means to secure the rear straps in place and prevent the clip from sliding on the straps.

The rear strap stabilizer clip provides an additional support point in the helmet's strapping system. The stabilizer clip is moveable along the length of the rear strap, which permits the support point to be adjusted by the wearer. Moreover, by having a bridge between the rear straps located at a point distal from the back portion of the helmet, the rear straps can be adjusted and positioned more comfortably under the earlobes of the wearer. The present strapping system's use of a rear stabilizer clip acts to more securely anchor the helmet on the head.

The rear strap stabilizer clip can take several forms that are generally integrally molded to have strap receiving slots that are formed by the base plate member and a moveable upper cover member, and gripping means to hold the clip in place on the straps. The rear stabilizer clip also maintains the orientation of the rear straps in a generally flat parallel position.

The gripping means can take the form of projections that are provided on both the base plate member and the upper cover member of the clip in order to engage and retain the rear straps in the slots. The straps can also be threaded through slots formed in a base plate member, wherein the edges of the slots act as the gripping means.

The present invention is directed to "multi-purpose" helmets and, without limitation, bicycle helmets, in-line roller skating helmets, ski helmets, skate board helmets, ice skating helmets, roller skating helmets, etc.

Additional objects and advantages of the invention will be set forth in the description which follows, or may be learned by practice of the invention.

BRIEF DESCRIPTION OF THE DRAWINGS

The accompanying drawings, which are incorporated in and constitute a part of the specification, schematically illustrate embodiments of the invention.

DETAILED DESCRIPTION OF THE INVENTION

The present invention will be described in terms of the various preferred embodiments.

Figure 1:
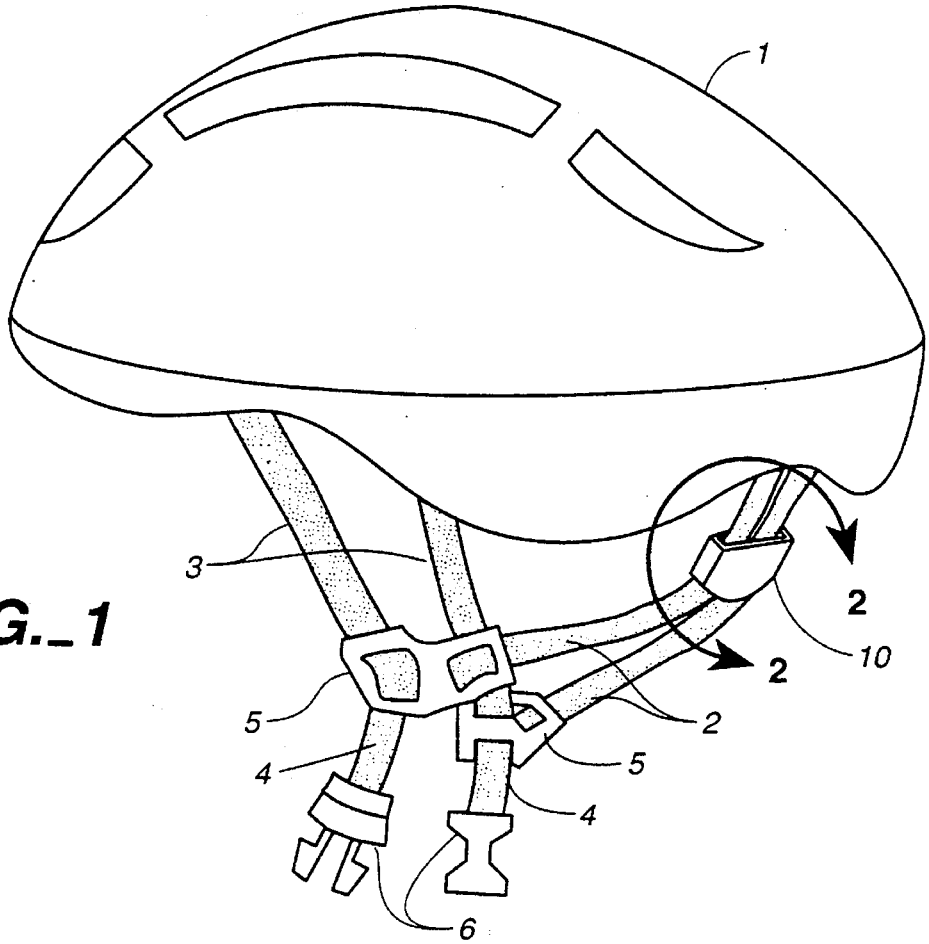
FIG. 1 is a perspective view of a helmet and strapping system incorporating the present invention.

In FIG. 1, a helmet 1 has a strapping system according to the present invention. The strapping system includes two rear straps 2 and two front straps 3 that are connected by strap assembly clips 5. Extending from the two strap assembly clips 5 are chin straps 4 and mateable clip elements 6. The rear strap stabilizer clip 10 joins the rear straps 2 at a position along the straps that is distal from the point of attachment at the back portion of the helmet 1. The rear strap stabilizer 10 can be positioned by the wearer so as to provide a comfortable and stable fit on the wearer's head.

Figure 2:
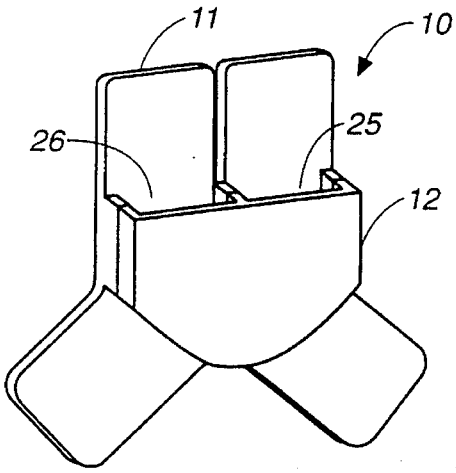
FIG. 2 is a perspective view of an embodiment of the rear strap stabilizer clip of the present invention in a closed position.

An enlarged view of the rear strap stabilizer clip 10 is shown in FIG. 2. The rear strap stabilizer clip 10 has a base plate member 11 and an upper cover member 12, which has hinged and free ends. The base plate member 11 has a generally inverted Y-shape. The rear strap stabilizer clip 10 has slots 25 and 26 that are formed by the base plate member 11 and the upper cover member 12 for placement of the rear helmet straps. The slots 25 and 26 orient the straps in a generally parallel position with each other.

Figure 3:
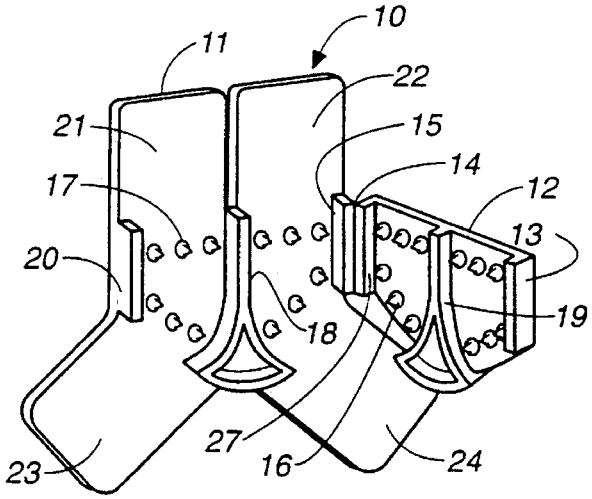
FIG. 3 is a perspective view of the rear strap stabilizer clip shown in FIG. 2 in an opened position.

As shown in FIG. 3, the rear strap stabilizer clip 10 can be opened by disengaging a locking means (not shown) and swinging upper cover member 12 by hinge 14 to an open position. The base plate member 11 has upper surfaces 21 and 22 and lower surfaces 23 and 24 upon which the rear straps will lie. The rear straps are held in slots 25 and 26 formed by the sidewalls 13, 15, 20 and 27 and inverted Y-shape center guidewalls 18 and 19. The slots of the rear strap stabilizer clip are sized to accommodate most standard helmet straps. The hinge 14 can also be placed between sidewalls 13 and 20.

Projections 16 located on the inner surface of the upper cover member 12 and projections 17 on the base plate member 11 act to prevent the rear strap stabilizer clip 10 from accidentally sliding on the rear straps after the clip 10 is positioned. It is preferred that projections 16 and 17 be conically shaped, although other suitable shapes may be used. Alternately, the inner surfaces of the rear strap stabilizer clip 10 can be textured to provide friction, whereby the movement of the rear straps can also be prevented. The projections 16 and 17 grip the rear straps holding them in place once the wearer determines the ideal location for the rear strap stabilizer clip's placement.

Various locking means for locking the stabilizer clip 10 may be used with the invention, such as a clasp, snap, latch, etc. It is within the skill of the ordinary artisan to choose an appropriate locking means and determine its placement, depending on the shape of the rear stabilizer chip. It is also within the scope of the invention to vary the number of locking means used in the design of the rear strap stabilizer clip. In the embodiment shown in FIG. 3, the locking means may be placed on sidewalls 13 and 20 and/or center guidewalls 18 and 19.

Figure 4:
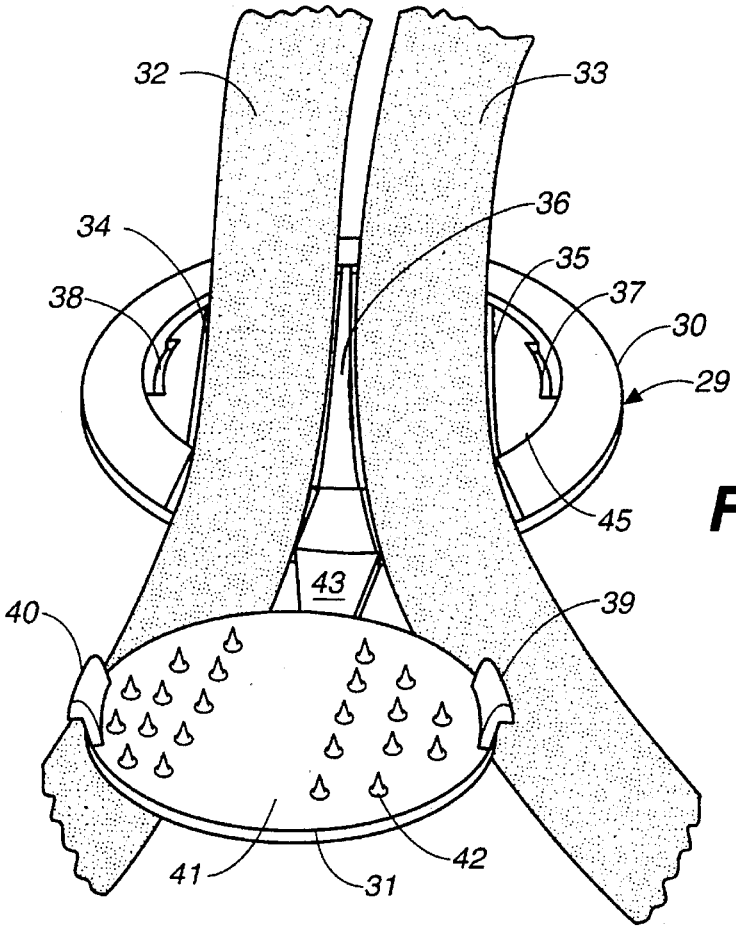
FIG. 4 is a perspective view of an alternative embodiment of the rear strap stabilizer clip of the present invention in an opened position.
Figure 5:
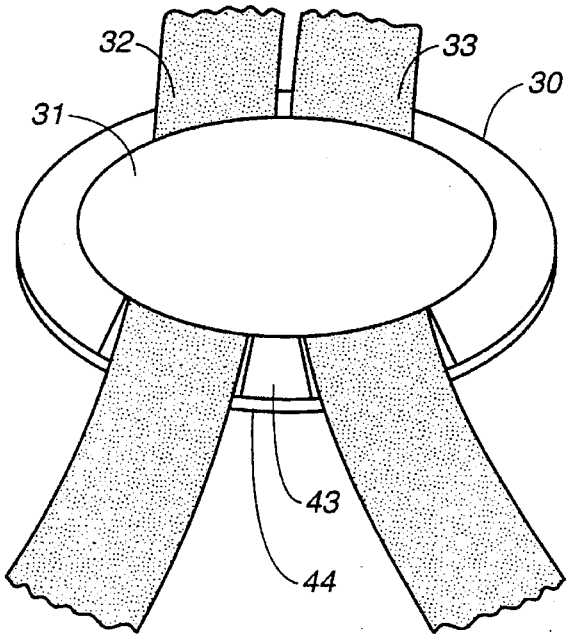
FIG. 5 is a perspective view of the rear strap stabilizer clip shown in FIG. 4 in a closed position.

An alternative embodiment of the present invention is shown in FIGS. 4 and 5. Rear strap stabilizer clip 29 has a base plate member 30 and upper cover member 31 that are generally circular. The upper cover member 31 is connected to the base plate member 30 by a extension member 43 and a hinge 44. The rear straps 32 and 33 are positioned in slots 34 and 35 in the base plate member 30. The slots 34 and 35 are recessed channels formed in base plate member 30. A center guidewall 36 separates the two rear straps 32 and 33. In this embodiment, the slots 34 and 35 are further apart at the bottom of the clip and the hinge 44 is placed between the slots. The base plate member 30 has a recessed portion 45 that allows the upper cover member 31 to fit in mateable engagement, as shown in FIG. 5. The upper cover member has a pair of projecting locking elements 39 and 40 that engage a pair of recessed locking elements 37 and 38.

As shown in FIG. 4, the inner surface 41 of upper cover member 31 has projections 42, which act to hold straps 32 and 33 in place. The slots 34 and 35 may also have similar projections for preventing the straps from sliding.

Figure 6:
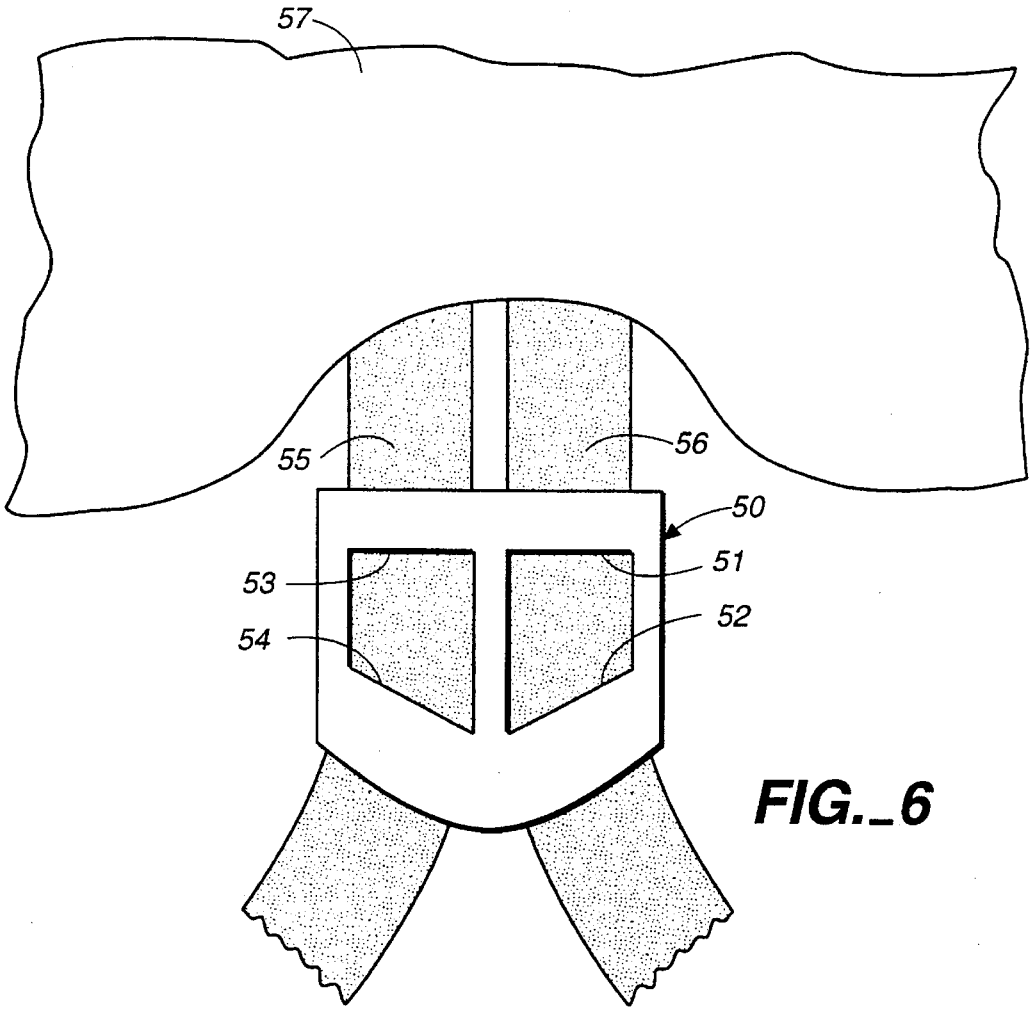
FIG. 6 is a second alternative embodiment of the invention that uses slots in the base plate member.

FIG. 6 is an alternative embodiment of the present invention. The rear strap stabilizer clip 50 is a generally flat plate that has slots 51, 52, 53 and 54. Slots 51 and 53 are horizontal and on the same level, while slots 52 and 54 are diagonal and form a V-shape. Rear strap 56 is shown inserted through slot 52 from the back-side of clip 50 and through slot from the front-side. Rear strap 55 is also shown inserted in slots 53 and 54. Naturally, the straps may be inserted into slots 51 and 53 from the front. The rear straps 55 and 56 are shown connected to the back portion of a helmet 57. The rear strap stabilizer clip 50 has slots that allow the straps to form an inverted Y-shape in a natural manner so as to provide an additional anchoring point in the strapping system of the helmet. This embodiment eliminates the need for a cover. However, this embodiment does not permit the ease of adjustment which is available in the embodiments that have a moveable upper cover member.

Figure 7:
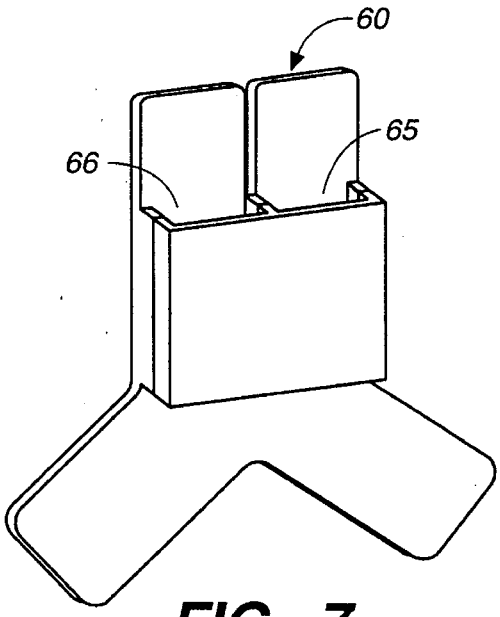
FIG. 7 is a perspective view of a modified embodiment of the invention as shown in FIG. 2 in a closed position.
Figure 8:
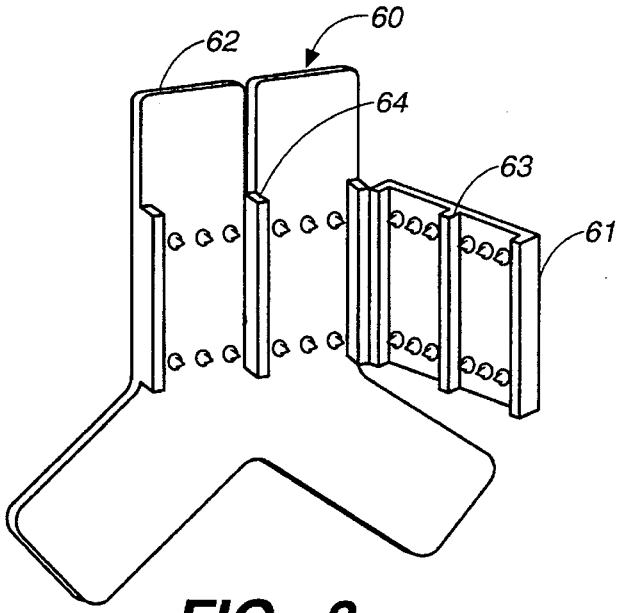
FIG. 8 is a perspective view of the rear strap stabilizer clip shown in FIG. 7 in an opened position.

The modified design shown in FIGS. 7 and 8 is generally similar to that of FIGS. 2 and 3. The rear strap stabilizer clip 60 has base plate member 62 and upper cover member 61 that form slots 65 and 66. In this embodiment, the center guidewall 63 on upper cover member 61 and the center guidewall 64 on base plate member 62 have a linear construction.

In addition, it is within the scope of the invention to provide a concave surface on the back of the base plate member in each of the aforementioned embodiments. The curved surface permits the rear strap stabilizer clip to fit better and feel more comfortable.

According to the present invention, the rear strap stabilizer clip can be easily and inexpensively fabricated in one piece by, for example, injection molding. In the embodiment shown in FIG. 6, the clip can either be die-cut or formed by injection molding since it does not have a movable upper cover. The rear strap stabilizer clip may be fabricated from a suitable polymeric material, such as polypropylene.

Finally, since numerous modifications and changes will readily occur to those skilled in the art, it is not desired to limit the invention to the exact constructions and operations shown and described, and accordingly all suitable modifications and equivalents may fall within the scope of the invention.

What is claimed is:

1. A helmet having a middle back portion, said helmet having a strapping system to secure said helmet to a wearer, said strapping system comprising first and second straps that are attached to a back portion of said helmet, a moveable rear stabilizer clip providing a bridge between said first and second straps at a location substantially under the middle back portion of the helmet, said first and second straps extending in substantially adjacent, parallel fashion from the middle back portion of the helmet to said rear stabilizer clip, said rear stabilizer clip including a junction plate member having slots for receiving said first and second rearward straps.

2. A helmet having a strapping system to according to claim 1 wherein said helmet is a bicycle helmet.

3. A rear stabilizer clip for bridging first and second rearward straps of a helmet at a position distal from a back portion of said helmet, said clip comprising:

a base plate member having a generally inverted Y-shape, first and second sidewalls and a center guidewall, and a first locking element, said first sidewall and said center guidewall forming a first slot for holding said first rearward strap, said center guidewall and said second sidewall forming a second slot for holding said second rearward strap;

a moveable upper cover member connected to said first sidewall or said second sidewall by a hinge, said upper cover member being congruently shaped to cover a middle portion of said base plate member, and having a second locking element for releasably engaging said first lock element; and gripping means located in said first and second slots for holding said first and second rearward straps within said clip.

4. A rear stabilizer clip according to claim 3 wherein said gripping means is a plurality of conical projections on said base plate member and said upper cover member.

5. A rear stabilizer clip according to claim 3 wherein said center guidewall has an inverted Y-shape.

6. A rear stabilizer clip for bridging first and second rearward straps of a helmet at a position distal from a back portion of said helmet, said clip comprising:

a base plate member, a cover member and gripping means;

said base plate member having first and second channels for holding said-first and second rearward straps, respectively, a recessed portion for accommodating said cover member and at least one first locking element;

said cover member being connected by a hinge to said base plate member and shaped to provide a mateable fit with said recessed portion and having at least one second locking element for releasable engagement with said first locking element;

said gripping means being located in said first and second channels and on said cover member; and said hinge being positioned at a bottom portion of said base plate member between said first and second channels.

7. A helmet having a middle back portion, said helmet having a strapping system to secure said helmet to a wearer, said strapping system comprising first and second straps that are attached to a back portion of said helmet, a moveable rear stabilizer clip providing a bridge between said first and second straps at an exposed location substantially under the middle back portion of the helmet, said rear stabilizer clip including a junction plate member having slots for receiving said first and second rearward straps.

8. A helmet having a middle back portion, said helmet having a strapping system to secure said helmet to a wearer, said strapping system comprising first and second straps that are attached to a back portion of said helmet, a moveable rear stabilizer clip providing a bridge between said first and second straps at an exposed location substantially under the middle back portion of the helmet, said rear stabilizer clip including a junction plate member having at least two slots for receiving said first and second rearward straps.

* * * * *